US009151536B2

(12) United States Patent
Buchstab et al.

(10) Patent No.: US 9,151,536 B2
(45) Date of Patent: Oct. 6, 2015

(54) REFRIGERATION DEVICE COMPRISING A DISPENSING DEVICE

(75) Inventors: Martin Buchstab, Bopfingen (DE); Irene Dumkow, Sontheim (DE); Adolf Feinauer, Giengen (DE); Klaus Flinner, Zöschingen (DE); Bernd Heger, Haunsheim (DE); Peter Nalbach, Kirchheim/Nabern (DE); Kasim Yazan, Ulm (DE)

(73) Assignee: BSH Hausgeraete GmbH, Munich (DE)

( * ) Notice: Subject to any disclaimer, the term of this patent is extended or adjusted under 35 U.S.C. 154(b) by 1619 days.

(21) Appl. No.: 12/085,967

(22) PCT Filed: Oct. 31, 2006

(86) PCT No.: PCT/EP2006/067962
§ 371 (c)(1),
(2), (4) Date: May 28, 2008

(87) PCT Pub. No.: WO2007/062951
PCT Pub. Date: Jun. 7, 2007

(65) Prior Publication Data

US 2009/0282856 A1 Nov. 19, 2009

(30) Foreign Application Priority Data

Nov. 30, 2005 (DE) ..... 10 2005 057 161

(51) Int. Cl.
*B67D 7/80* (2010.01)
*F25D 23/12* (2006.01)
*A47B 96/20* (2006.01)

(Continued)

(52) U.S. Cl.
CPC ..... *F25D 23/126* (2013.01); *A47B 96/20* (2013.01); *F25C 5/005* (2013.01); *F25D 23/10* (2013.01); *F25C 2400/10* (2013.01); *F25D 2400/18* (2013.01)

(58) Field of Classification Search
CPC ... F25D 23/126; F25D 23/10; F25C 2400/10; F25C 2400/18; F25C 5/005; A47B 95/20
USPC ..... 222/146.6, 182, 146.1, 530–538, 129, 222/129.1, 639–642; 62/98, 389–400
See application file for complete search history.

(56) References Cited

U.S. PATENT DOCUMENTS 3,476,295 A 11/1969 Telfer
4,555,049 A * 11/1985 Mawby et al. ..... 222/517

(Continued)

FOREIGN PATENT DOCUMENTS

EP 0 382 914 8/1990
EP 0 449 061 10/1991

(Continued)

OTHER PUBLICATIONS

International Search Report PCT/EP2006/067962.

*Primary Examiner* — Lien Ngo
(74) *Attorney, Agent, or Firm* — Laurence A. Greenberg; Werner H. Stemer; Ralph E. Locher

(57) ABSTRACT

A dispensing device for a free-flowing or pourable refrigerated product is situated on the front face of the housing of a refrigeration device. A sleeve, through which the dispensing device is accessed, protrudes beyond the front face and is surrounded by a peripheral frame that protrudes beyond the sleeve.

17 Claims, 3 Drawing Sheets

(51) Int. Cl.
*F25C 5/00* (2006.01)
*F25D 23/10* (2006.01)

(56) References Cited

U.S. PATENT DOCUMENTS 5,359,795 A * 11/1994 Mawby et al. ..... 40/405
5,526,854 A * 6/1996 Unger ..... 141/351
7,007,500 B2 * 3/2006 Lee ..... 62/389
7,340,915 B2 * 3/2008 Kwon ..... 62/398
7,563,511 B2 * 7/2009 Koo ..... 428/428
2002/0083729 A1 7/2002 Skinner
2003/0205585 A1 * 11/2003 Mitchell et al. ..... 222/108
2004/0183413 A1 9/2004 Koo
2004/0183414 A1 9/2004 Kwon
2005/0072178 A1 4/2005 Park et al.
2006/0090496 A1 * 5/2006 Adamski et al. ..... 62/344

FOREIGN PATENT DOCUMENTS

EP 1 580 502 9/2005
GB 2 246 195 1/1992

* cited by examiner

REFRIGERATION DEVICE COMPRISING A DISPENSING DEVICE

The present invention relates to a refrigeration appliance comprising a housing and a dispensing device arranged on a front face of the housing for a free-flowing or pourable refrigerated product such as in particular ice and chilled water. Refrigeration appliances of this type enjoy increasing popularity with users.

Integratable refrigeration appliances are also required, in other words, their door can be provided with a superimposed decorative plate, the design features of which are tailored to those of the fronts of adjacent furniture or devices. To be able to align such a decorative plate precisely to the adjacent fronts, said decorative plate is mostly adjustable in several spatial directions in respect of the supporting door.

If a dispensing device for ice or water is integrated into the door of a refrigeration appliance with a superimposed decorative plate, then the problem arises that the decorative plate is not permitted to block access to the dispensing device. If a window is cut into the decorative plate for access to the dispensing device, the window also moves in respect of the dispensing device when adjusting the decorative plate. If the dispensing device, as is mostly the case, is integrated into a recess on the front face, recess and window may partially overlap or parts of the front face are visible between the edges of the recess and those of the window according to adjustments of different widths. It is thus difficult to produce a visually attractive transition between the door and the decorative plate in the region of the dispensing device. An adjustability of the decorative plate in the depth direction, at right angles to the front face, also implies that an intermediate space is available between the front face and the decorative plate, into which a refrigerated product which has spilt onto the dispensing device can enter.

One known possibility of avoiding these problems is to position the dispensing device in a region of the front face which does not belong to the door, and does not need to be covered by the adjustable decorative plate. This solution is however unsatisfactory as it results in a poor use of space in the refrigeration appliance.

The object of the present invention is to create a refrigeration appliance comprising a dispensing device arranged on the front face of its housing, which is suited to being equipped with a superimposed decorative plate and to create here an attractive transition between the front face and the decorative plate despite the potential adjustability of the decorative plate, said transition preventing water from penetrating into an intermediate space between the front side and the decorative plate.

The object is herewith achieved in that a sleeve, through which the dispensing device can be accessed, protrudes beyond the front face of the refrigeration appliance and is surrounded by a peripheral frame that protrudes beyond the sleeve.

According to a first embodiment, the frame can be compressed elastically, in order to fill an intermediate space between the sleeve and a section of the decorative plate surrounding it and having a width which is variable depending on the adjustment of the decorative plate.

According to a second embodiment, the frame and the front face delimit a groove running around the sleeve, into which groove the decorative plate can engage, with it expediently resting on the frame. The frame conceals a gap between the decorative plate and the sleeve. This gap can thus have different widths on the different sides of the sleeve, without this being perceivable to the user.

The sleeve can be compressed in the longitudinal direction, for instance by using an elastically deformable material for at least one part of the sleeve or by forming the sleeve from telescopically meshing parts. One end of the sleeve can thus rest against the front side of the housing and the length of the sleeve can be adjusted to a width of the intermediate space between the front side and the decorative plate which differs according to adjustments.

Alternatively, provision can be made for the sleeve to engage in a recess of the front face. It is then possible to compensate a variable width of the intermediate space between the decorative plate and the front side by means of a correspondingly differently deep engagement of the sleeve into the recess.

The engagement of the sleeve into the recess can be free of play in the horizontal and/or vertical direction, since the sleeve does not need to follow an adjustment movement of the decorative plate in the horizontal and/or vertical direction. There is also the possibility of anchoring the sleeve into the recess.

Alternatively, the sleeve can be anchored onto the decorative plate and can be adjusted together with this in respect of the front face. In this case, the sleeve is to engage into the recess with play in the width direction of the front face and in the vertical direction.

At its end inserted into the recess, the sleeve can be sealed by a wall on at least one part of its cross-section in order to prevent splashed water from reaching between the outside of the sleeve and the surrounding wall of the recess.

In accordance with a simple embodiment, the dispensing device is permanently mounted on the front side. This is particularly expedient if the sleeve engages in the recess free of play in the width direction of the front face or the vertical direction.

In accordance with a preferred embodiment, the dispensing device can be adjusted in respect of the front face in at least one spatial direction. This allows for the possibility of adjusting the position of the outlet of the dispensing device to that of the sleeve, so that a container positioned at a central point or at an otherwise emphasized point of the sleeve is reliably filled with dispensed water or ice. In the case of the horizontal and/or vertical sleeve which engages free of play into the recess, an adjustability of the dispensing device in the depth direction, at right angles to the front face, is sufficient. In the case of a sleeve which engages horizontally and vertically into the recess with play, the dispensing device is preferably to be adjustable in two horizontal spatial directions; an adjustability in the vertical direction is however possible, but not absolutely necessary, since when water or ice is dispensed in the vertical direction, it does not depend on a height difference between the dispensing device or recess as to whether a container positioned in the recess is filled or not.

BRIEF DESCRIPTION OF THE DRAWINGS

Further features and advantages of the invention result from the description which follows of exemplary embodiments with reference to the appended figures, in which.

DETAILED DESCRIPTION OF THE PRESENT INVENTION

Figure 1:
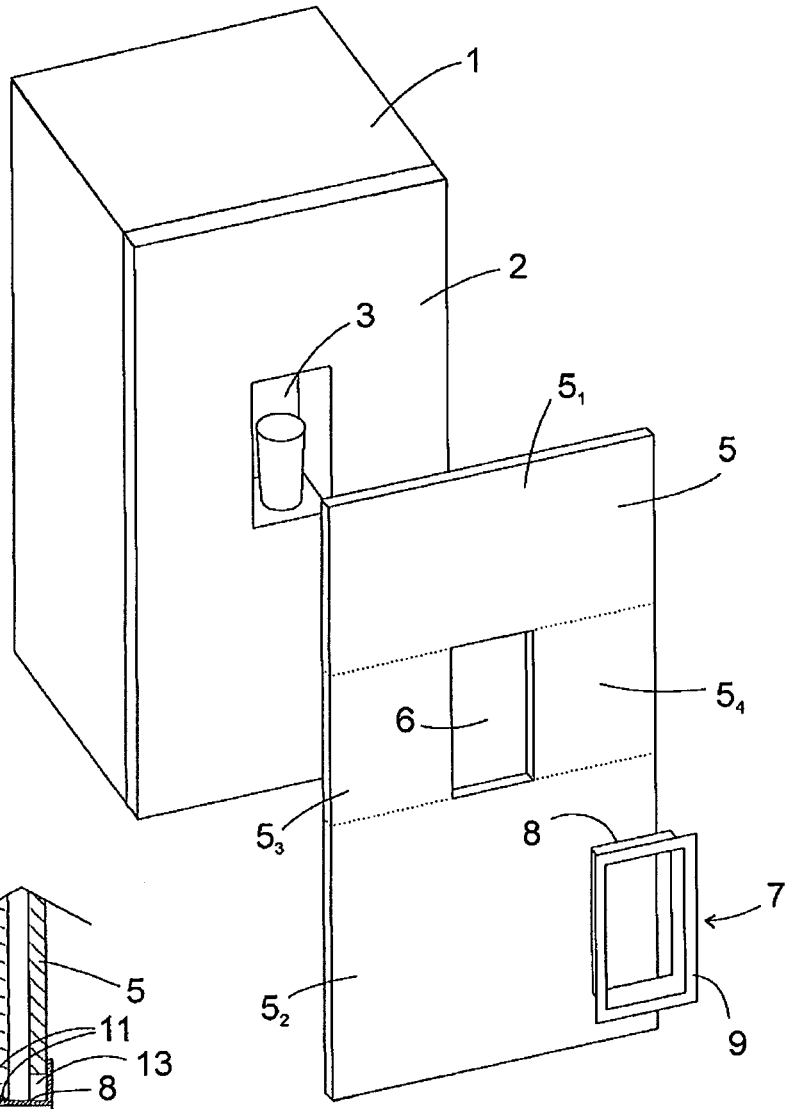
FIG. 1 shows an exploded perspective view of a refrigeration appliance comprising a dispensing device, a decorative plate and a sleeve according to the present invention.

FIG. 1 shows a perspective view of a refrigeration appliance such as for instance a refrigerator, a freezer or a fridge/freezer combination with a body 1 and a door 2 hinged to the body, which forms the entire front face of the device. An automatic ice maker and a water tank are located inside the device, which since they are known per se are not described here. A dispensing device for ice from the ice maker and water from the tank is disposed on the ceiling of a recess 3, which is formed centrally in the door 2. The dispensing device is not visible in FIG. 1.

The door 2 is provided in order to be faced with a decorative plate 5. On its rear side which is not visible in the Figure, the decorative plate 5 is provided with fittings for adjustably hanging the decorative plate 5 on the door 2 vertically as well as in the width and depth direction of the body. As suitable fittings are known to the person skilled in the art, their installation is not detailed at this point.

The edge lengths of the decorative plate 5 are marginally larger than those of the door 2. The oversize of the decorative plate 2 is selected as a function of the adjustable freedom of movement of the decorative plate 5 in the vertical direction as well as in the width direction such that the door 2 is completely concealed by the decorative plate 5 in each possible position thereof.

The decorative plate 5 is provided with a central cutout 6, through which the recess 3 can be accessed when the decorative plate 5 is mounted on the door. The edge lengths of the cutout 6 are determined by the requirement that in each position which the decorative plate 5 can assume in respect of the door 2, the recess 3 is completely uncovered.

An adapter 7, which can be formed in one piece from plastic for instance, includes a sleeve 8 of a rectangular cross-section, the edge lengths of which are dimensioned in order to enable a form-fit engagement of the sleeve 8 into the recess 3. A peripheral web forming a frame 9 protrudes beyond one end of the sleeve 8 which faces away from the recess 3. With an adjacent side wall of the sleeve, the web in each case spans an angle which is marginally smaller than a right angle. The width of the web is marginally larger than the adjustable freedom of movement of the decorative plate 5 in the vertical direction and in the width direction, in order to ensure that the frame 9 completely conceals the cutout 6 in each position which the decorative plate 5 can assume on the door 2.

Figure 2:
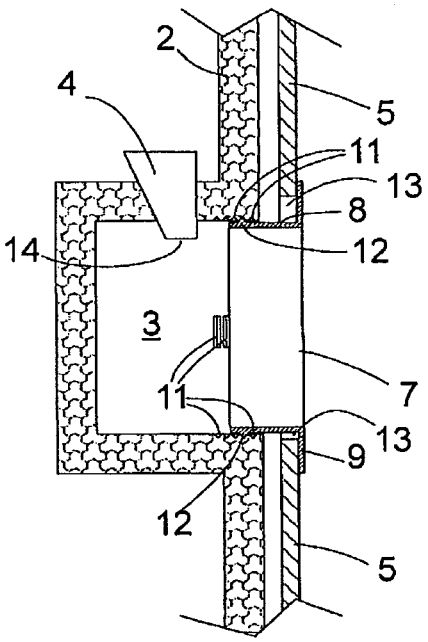
FIG. 2 shows a schematic section through the door of the refrigeration appliance in FIG. 1 in the vertical direction in an assembled and adjusted state.

FIG. 2 shows a schematic partial section through the door 2, the decorative plate 5 and the adapter 7 in an assembled and adjusted state. Groups of locking notches 11 are formed on the interior wall of the recess 3, and each group is assigned a complementary locking projection 12 on the exterior of the sleeve 8. The adapter 7 can be determined in a plurality of positions which are equally distanced in the depth direction by means of locking into a notch 11 of each group in each instance. The adapter 7 is pushed so deep into the recess 3 that the frame 9 marginally deforms elastically and the angle between the sleeve 8 and frame 9 is slightly widened. This ensures that the outer edge of the frame 9 rests jointlessly on the exterior of the decorative plate 5.

A gap 13 exists between the edges of the cutout 6 and the sleeve 8, the width of which gap is variable depending on the adjustment of the decorative plate 5.

Figure 4:
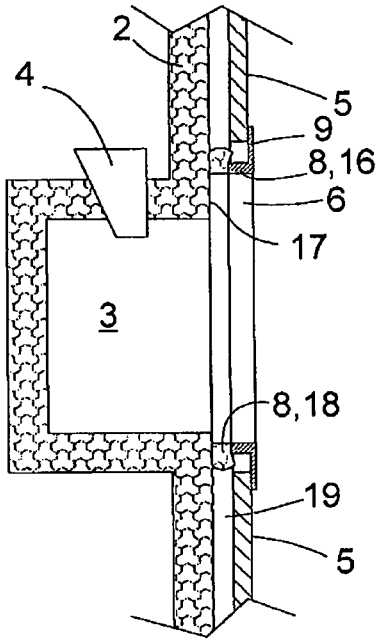

The dispensing device is shown schematically in FIG. 4 as a funnel, which extends through the cover of the recess and has an outlet opening 14 for water and/or ice on its lower end. Any dispensing device which allows water and/or ice to fill a container positioned in the recess 3 can be provided instead of the funnel.

Figure 3:
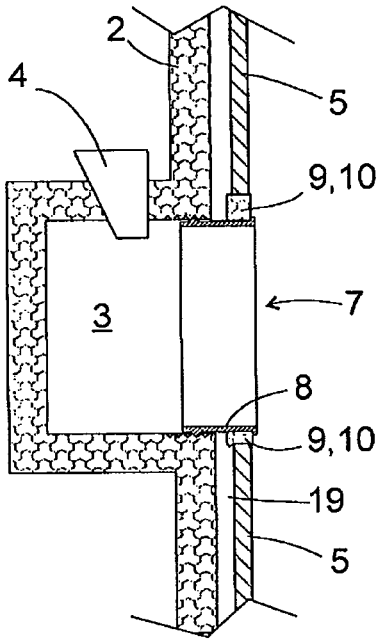
FIGS. 3 to 7 show sections similar to FIG. 2 according to the second through to the sixth embodiments of the invention.

In a section similar to FIG. 2, FIG. 3 shows a second embodiment of the invention. The door 2, the dispensing device 4 and the decorative plate 5 are in turn identical to those in the embodiment in FIGS. 1 and 2. Again the adapter 7 has a sleeve 8 with a rectangular cross-section, which engages into a recess 3 of the door and is anchored herein, as well as a frame 9 that protrudes beyond the end of the sleeve 8 facing away from the recess 3. The frame 9 is located in a plane with a decorative plate 5 and consists of an elastically compressible plastic material 10, which fills the gap 13 between the sleeve 8 and the edges of the cutout 6. The decorative plate 5 is completely uncovered.

A third embodiment is shown in FIG. 4, again in a section similar to that in FIG. 2. With this embodiment, the cutout 6 in the decorative plate 5 is significantly larger than the recess 3. The frame 9 and a front segment 16 of the sleeve 8 are formed from a solid plastic material. The frame 9 is stuck to the exterior of the decorative plate 5, with the position of the frame 9 on the decorative plate 5 being selected such that a permanently predetermined region on the front side of the door 2 remains accessible through the sleeve 8, which includes the recess 3 as well as a region 17 of the door exterior which is adjacent to the recess 3, in which operating keys to control the dispensing of water and ice can be provided for instance.

A rear segment 18 of the sleeve 8 consists of an elastically compressible foam and is compressed between the door 2 and the front segment 16 and prevents water which has spilt into the recess 3 from penetrating into the intermediate space 19 between the front side of the door and the decorative plate 5.

Figure 5:
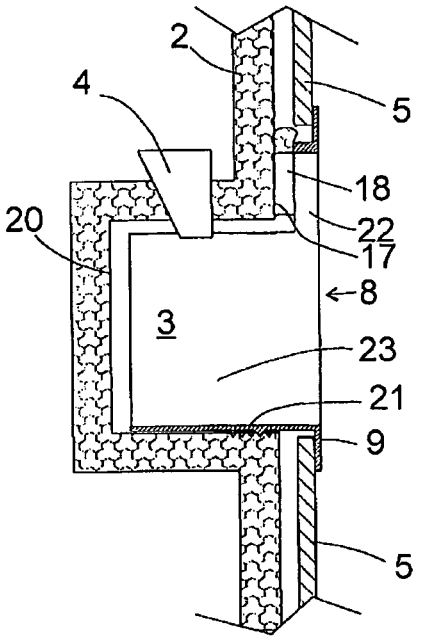

The embodiment illustrated in FIG. 5 differs from that shown in FIG. 2 on the one hand by the length of the sleeve 8. With the embodiment in FIG. 5, this corresponds to the depth of the recess 3 and to a specified minimal admissible strength of the decorative plate 5, so that if such a minimally strong decorative plate is assembled in indirect contact with the door 2, one end of the sleeve 8 touches the rear wall 20 of the recess, whereas at the other end of the sleeve 8 the frame 9 rests externally against the decorative plate. A lower wall 21 of the sleeve 8 thus forms a flat adjusting surface which essentially extends over the entire depth of the recess 3, on which adjusting surface a container to be filled can be reliably and securely positioned.

Another deviation from the embodiment in FIG. 2, which can be realized independently of the afore-described embodiment, is the division of the sleeve 8 into an upper sector 22 and a lower sector 23, of which only the lower sector 23 engages into the recess 3, while the upper sector 23, as described in respect of FIG. 4, rests against the exterior of the door 2, in order to free up a control panel in the region 17. As there is no risk in this upper sector 22 that spilt water can reach between the door and the decorative plate, the deformable rear section 18 can be omitted, deviating from the description given in respect of FIG. 4.

Figure 6:
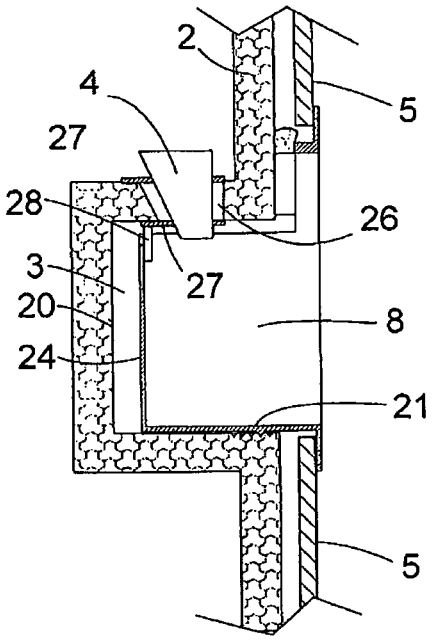

The embodiment illustrated in FIG. 6 is a further development of the embodiment in FIG. 5. On its end engaging into the recess 3, the sleeve 8 is largely sealed by a vertical rear wall 24 as an additional safety measure against the penetration of water between the sleeve 8 and the surrounding inner wall of the recess 3.

One consequence of the deep engagement of the sleeve 8 into the recess 3 in the embodiments in FIGS. 5 and 6 is that a reference mark, which shows where a container is to be placed, in order to be optimally filled with water or ice dispensed by the dispensing device 4, can no longer be attached to the base of the recess 3, but must instead be attached to the lower wall 21 of the sleeve 8 and consequently correctly indicates the filling point at one single position of the sleeve 8. To nevertheless enable a simple positioning of a container to be filled, in the embodiment in FIG. 6, the dispensing device 4 is not permanently inserted into the door 2, but can instead be moved in a window 26, which is cut into the cover of the recess 3, in the depth direction. Insulation plates 27 which are permanently fixed to the dispensing device 4 are disposed above and below the ceiling and are dimensioned such that they completely cover the window 26 with every position of the dispensing device 4, in order to prevent an influx of hot air into the device through the window 26.

An adjusting pin 28 can be seen on the lower insulation plate 27, which engages downwards into the recess 3. If the adjusting pin 28 is removed or swung flat against the insulation plate, the sleeve 8 can be easily inserted into the recess 3. By subsequently fastening or swinging out the adjusting pin 28 to a point of the lower insulation plate 27 provided herefor, as shown in the Fig. and by guiding said adjusting pin 28 against the rear wall 24 along with the dispensing device 4, a correct positioning of the dispensing device 4 in respect of a marker on the lower wall 21 is ensured, which indicates the correct position of the container to be filled.

Figure 7:
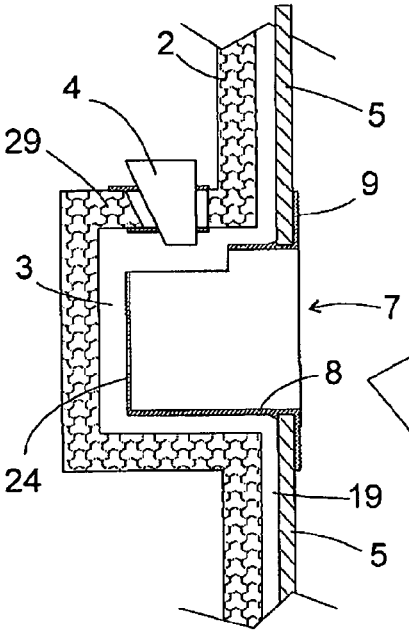

With the embodiment shown in FIG. 7, the adapter 7 is permanently anchored to the decorative plate 5 and its sleeve 8 engages with play into the recess 3 in all three spatial directions. As with the embodiment in FIG. 6, the dispensing device 4 can be adjusted in the depth direction in order to adjust to the variable insertion depth of the sleeve 8 into the recess 3. Supplementary means (not shown here) such as the adjusting pin 28 can also be used here to position the dispensing device 4 in respect of the sleeve 8.

Figure 8:
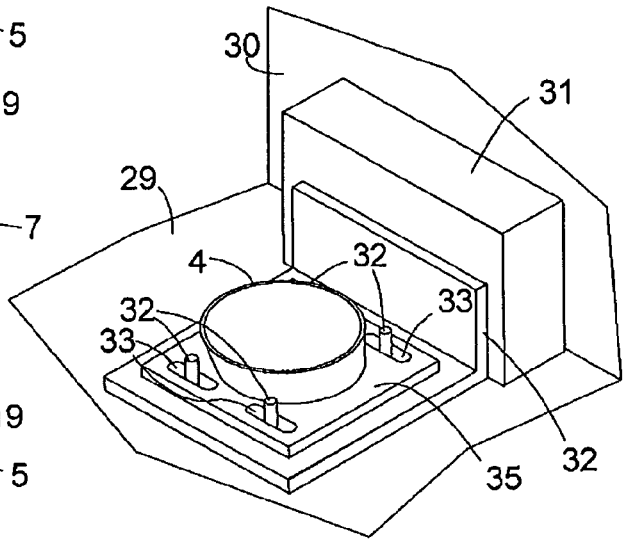
FIG. 8 shows a perspective partial view of a region of the door of the refrigeration appliance according to a seventh embodiment.

In the case of a sleeve 8 which can be adjusted in respect of the door 2 not only in the depth direction but also in the width direction, as shown in FIG. 7, it is desirable to be able to fix the dispensing device 4 at a location which is adjusted to the position of the sleeve 8 in the width and depth direction. One simple possibility for this is shown in FIG. 8. The figure shows a perspective partial view of the ceiling 29 of the recess 3 and a section 30 of the door leaf adjacent thereto. A spacer 31 is detachably fastened at an angle between the ceiling 29 and the door leaf 30. The spacer 31 is selected from a set of spacers of different thicknesses which are suited to insertion depths of the sleeve 8 into the recess 3. An angle profile 32 is fastened to the spacer 31. A horizontal leg of the angle profile 32 rests on the ceiling 29 and partially conceals the window 26 which is not visible in the Figure. Headless screws 33 which are fastened to an angle profile 32 penetrate longitudinal holes 34 of a plate 25, upon which the dispensing device is held. The dispensing device pierces a longitudinal hole of the angle profile 32 which is covered in the figure, which, like the longitudinal holes 34, extends in the depth direction of the body. Screw nuts (not shown) are screwed onto the headless screws 33 in order to fix the dispensing device 4.

Figure 9:
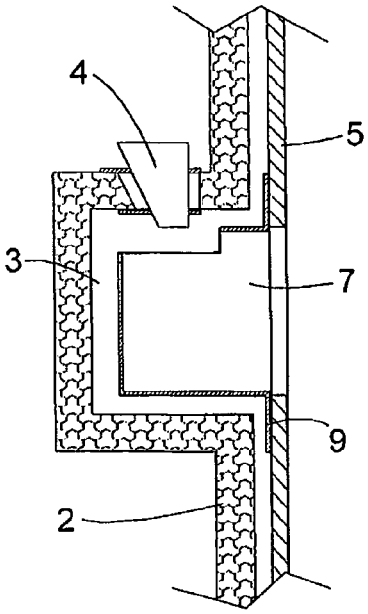
FIG. 9 shows a section similar to FIG. 2 according to an eighth embodiment.

FIG. 9 shows a further embodiment with an adapter 7 which is fastened to the decorative plate 5 and engages into the recess 3. Contrary to the embodiment in FIG. 7, in this embodiment the frame 9 of the adapter is fastened to the rear side of the decorative plate 5.

Since in the case of a single-piece decorative plate 5 it is difficult to manufacture the edges of the cutout 6 in an aesthetically similar fashion to the outer edges of the decorative plate 5, the embodiment in FIG. 9 is suited above all to use in connection with a decorative plate made of several parts, which is composed of several rectangular single pieces in each instance. One possible division of the decorative plate into such permanently connected individual pieces $\mathbf{5}_1$ to $\mathbf{5}_4$ is indicated by dotted lines in FIG. 2.

Figure 10:
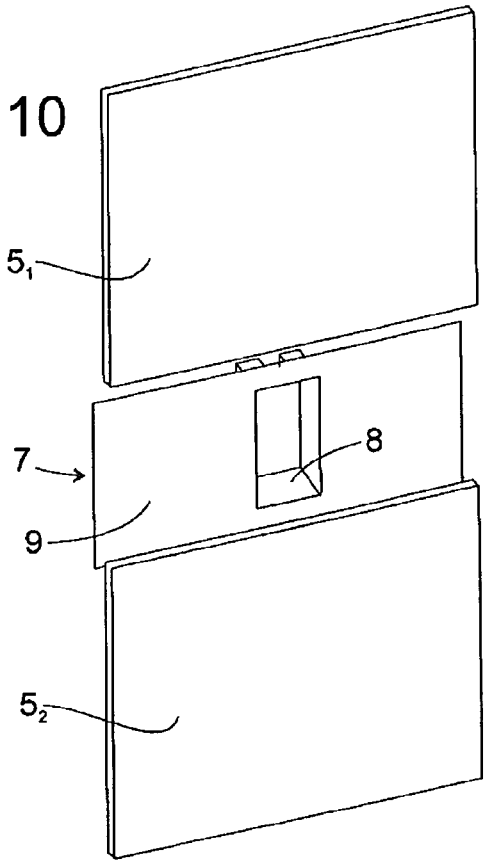
FIG. 10 shows a perspective view of a panel for a refrigeration appliance according to a ninth embodiment of the invention.

One further modification to the concept of FIG. 9 is shown in FIG. 10 on the basis of a perspective view. Instead of a single-piece decorative plate, two adjustable decorative plates $\mathbf{5}_1$, $\mathbf{5}_2$ which are independent of one another are provided, which extend above and below the adapter 7 over the entire width of the door. The frame 9 of the adapter 7 is widened in its lateral direction, its width is the same as that of the decorative plates $\mathbf{5}_1$, $\mathbf{5}_2$. The sleeve 8 engages vertically into the recess of the door free of play; the adapter 7 is adjustable in the width direction and depth direction, in order to move the frame 9 against the rear of the decorative plates $\mathbf{5}_1$, $\mathbf{5}_2$ and to align the lateral edges of the frame and decorative plates to one another.

The invention claimed is:

1. A refrigeration appliance comprising:

a housing having a back side and a front side;

a dispensing device accessible via the front side of the housing, the dispensing device operable to dispense a flowable product that has been cooled by the refrigeration appliance;

a sleeve having a through opening and having sides forming a sleeve periphery, the sleeve being positioned relative to the dispensing device such that access to the dispensing device can be had via the through opening of the sleeve and the sleeve protruding beyond the front side of the housing in a depth direction from the back side to the front side of the housing; and a peripheral frame connected to the periphery of the sleeve and protruding beyond the sleeve, wherein the peripheral frame is formed of an elastically compressible material, the peripheral frame and the front side of the housing delimiting a groove extending around the sleeve; and the sleeve engaging into a recess of the front side of the housing, and the sleeve being adjustable in the depth direction of the recess.

2. The refrigeration appliance as claimed in claim 1, wherein the sleeve has a longitudinal direction and the sleeve is compressible in its longitudinal direction.

3. The refrigeration appliance as claimed in claim 1, wherein the sleeve engages into the recess in a play-free manner in least one of the depth direction of the front side of the housing and a vertical direction of the housing.

4. The refrigeration appliance as claimed in claim 1, wherein the sleeve is anchored into the recess.

5. A refrigeration appliance comprising:

a housing having a back side and a front side;

a dispensing device accessible via the front side of the housing, the dispensing device operable to dispense a flowable product that has been cooled by the refrigeration appliance;

a sleeve having a through opening and having sides forming a sleeve periphery, the sleeve being positioned relative to the dispensing device such that access to the dispensing device can be had via the through opening of the sleeve and the sleeve protruding beyond the front side of the housing in a depth direction from the back side to the front side of the housing;

a peripheral frame connected to the periphery of the sleeve and protruding beyond the sleeve, wherein the peripheral frame is formed of an elastically compressible material;

the peripheral frame and the front side of the housing delimiting a groove extending around the sleeve and the sleeve engaging into a recess of the front side of the housing; and a decorative plate superimposed on the front side of the housing and wherein the sleeve is anchored onto the decorative plate and the sleeve and the decorative plate are both adjustable relative to the front side of the housing.

6. The refrigeration appliance as claimed in claim 5, wherein the sleeve engages into the recess in a manner permitting free play in a horizontal direction and in a vertical direction.

7. The refrigeration appliance as claimed in claim 5, wherein an end of the sleeve is inserted into the recess and the sleeve is sealed by a wall on its at least one part of its cross-section at this end.

8. The refrigeration appliance as claimed in claim 1, wherein the dispensing device is permanently mounted on the front side of the housing.

9. The refrigeration appliance as claimed in claim 1, wherein the dispensing device is adjustable in at least one spatial direction relative to the front side of the housing.

10. The refrigeration appliance as claimed in claim 9, wherein the dispensing device is adjustable in at least one horizontal spatial direction relative to the front side of the housing.

11. A refrigeration appliance comprising:

an appliance housing having a back side and a front side;

a decorative plate attached to the front side of the housing, the decorative plate having a front face;

a dispensing device accessible through the decorative plate, the dispensing device operable to dispense a flowable product that has been cooled by the refrigeration appliance;

a sleeve having a through opening and having sides forming a sleeve periphery, the sleeve being positioned relative to the dispensing device such that access to the dispensing device can be had via the through opening of the sleeve and the sleeve protruding beyond the decorative plate in a depth direction from the back side to the front side of the housing; and a peripheral frame connected to the periphery of the sleeve and protruding beyond the sleeve in directions substantially parallel to the front face of the decorative plate, wherein the decorative plate is adjustable relative to the front side of the housing in directions substantially parallel to the front face of the decorative plate.

12. The refrigeration appliance as claimed in claim 11, wherein the peripheral frame forms an angle with the sleeve, the angle is less than 90 degrees when the peripheral frame is not in contact with the front face of the decorative plate, and the peripheral frame is elastically deformable such that the angle increases when a back side of the peripheral frame is pressed against the front face of the decorative plate.

13. The refrigeration appliance as claimed in claim 11, wherein the peripheral frame is elastically deformable such that the peripheral frame deforms when a back side of the peripheral frame is in position against the front face of the decorative plate.

14. The refrigeration appliance as claimed in claim 11, wherein the peripheral frame has a width in a horizontal direction of the appliance, and the width of the peripheral frame is less than a width of the front face of the decorative plate.

15. A refrigeration appliance comprising:

a housing having a back side and a front side;

a dispensing device accessible via the front side of the housing, the dispensing device operable to dispense a flowable product that has been cooled by the refrigeration appliance;

a sleeve having a through opening and having sides forming a sleeve periphery, the sleeve being positioned relative to the dispensing device such that access to the dispensing device can be had via the through opening of the sleeve and the sleeve protruding beyond the front side of the housing in a depth direction from the back side to the front side of the housing;

a peripheral frame connected to the periphery of the sleeve and protruding beyond the sleeve, wherein the peripheral frame is formed of an elastically compressible material and the peripheral frame forms an angle with the sleeve, the angle is less than 90 degrees when the peripheral frame is not in contact with the front side of the housing, and the peripheral frame is elastically deformable such that the angle increases when a back side of the peripheral frame is pressed against the front side of the housing.

16. The refrigeration appliance as claimed in claim 15, wherein the peripheral frame is elastically deformable such that the peripheral frame deforms when a back side of the peripheral frame is in position against the front side of the housing.

17. The refrigeration appliance as claimed in claim 1, wherein the peripheral frame has a width in a horizontal direction of the appliance, and the width of the peripheral frame is less than a width of the front side of the housing.

* * * * *